United States Patent [19]

Buckland

[11] 3,938,667

[45] Feb. 17, 1976

[54] COMBINATION TIE RACK

[76] Inventor: Bonnie P. Buckland, 21 Lanyard Ave., Trotwood, Ohio 45426

[22] Filed: Sept. 19, 1974

[21] Appl. No.: 507,406

[52] U.S. Cl. ..... 211/87; 211/13

[51] Int. Cl.[2] ..... A47F 7/00

[58] Field of Search..... 211/87, 13, 89, 60 T, 60 R; 248/225

[56] References Cited

UNITED STATES PATENTS

| | | | |
|---|---|---|---|
| 138,676 | 5/1873 | Mitchell | 211/67 |
| 655,739 | 8/1900 | Runtz | 211/87 |
| 1,687,129 | 10/1928 | Henninger | 211/87 X |
| 2,272,361 | 2/1942 | Troidl | 211/87 |
| 2,532,162 | 11/1950 | Goss | 211/89 X |
| 2,695,105 | 11/1954 | Mitchell | 211/89 |
| 2,860,788 | 11/1958 | Hardman | 211/89 |
| 3,270,889 | 9/1966 | Pochopien | 211/13 |
| 3,361,266 | 1/1968 | Williams | 211/87 |
| 3,705,653 | 12/1972 | Pereyra | 211/13 |

*Primary Examiner*—William H. Schultz
*Assistant Examiner*—Robert W. Gibson, Jr.
*Attorney, Agent, or Firm*—Biebel, French & Bugg

[57] ABSTRACT

A tie rack designed to support both untied and pretied neckties which includes a base plate, posts received in sockets formed in the base plate and projecting from a front face thereof, wire loops disposed between the posts with the ends of the loops received in the sockets, and adjustable attaching brackets telescopically receiving opposite ends of the base plate. The spacing of the posts and the loops is such that untied neckties can be draped over all of the posts while all of the wire loops are occupied simultaneously by pretied neckties with the hooks thereof engaging the loops.

2 Claims, 4 Drawing Figures

COMBINATION TIE RACK

BACKGROUND OF THE INVENTION

A number of designs have been proposed for necktie racks for display and storage purposes. For example, the early patent to Runtz, U.S. Pat. 655,739, discloses a display rack for supporting several pretied neckties of an older type. The patent to Henninger, U.S. Pat. 1,687,129, on the other hand, discloses a necktie holder for untied neckties which includes springs for holding the ties on the tie supports.

A further example is shown in the patent to Pedersen, U.S. Pat. No. 2,914,182, which discloses a tie rack which accommodates both untied four-in-hand ties and pretied bow ties. Another patent dealing with a tie rack for pretied neckties is that of Williams, U.S. Pat. No. 2,361,266. With regard to racks generally, the patent to Lodato, U.S. Pat. No. 2,606,711, discloses a hanger or rack having adjustable ends for mounting the hanger on a door.

While the majority of neckties sold in the United States are of the untied, four-in-hand type, pretied neckties of the type having a single clip near the rear center of the knot which are attached to the shirt of the wearer, have gained increasing popularity in recent years and it is quite common for a person to include both types of neckties in his wardrobe. Prior art tie racks, however, appear to be designed to support only a single type of tie, to be of unduly complicated and hence expensive design, or both.

Thus it will be seen that, despite an obvious interest in tie rack design for an extended period of time, as evidenced by the above noted patents, a need still exists for a combination tie rack which will not only accommodate both untied, four-in-hand type ties but the modern, pretied, clip attached ties on a single rack, but which is not undnly complicated in structure and hence prohibitively expensive to produce.

SUMMARY OF THE INVENTION

The present invention provides a combination tie rack which includes provision for supporting both untied, four-in-hand ties and pretied, clip attached ties on a single rack, but which is constructed such that the various rack components cooperate to provide an overall design which results in simplified manufacturing operations and commensurate reduction in production costs.

Specifically, the combination tie rack of the present invention includes a base plate having a series of spaced apart sockets formed therein along the length thereof. Received in these sockets are a plurality of posts which project outwardly from the front face of the base plate and are adapted to support thereon untied, four-in-hand ties.

A plurality of loops, preferably of generally semicircular configuration and conveniently formed of wire, are positioned intermediate each pair of adjacent posts with the ends of the loops received in the same sockets as the posts. The loops also project outwardly from the front face of the base plate and are adapted to be engaged by the hooks of pretied neckties of that type, and the spacing between adjacent posts and loops is such that all of the posts and loops can be occupied simultaneously by untied and pretied neckties.

Conveniently the base plate is provided with substantially C-shaped brackets, slidably and telescopically received on each end of the base plate. This allows the base plate to be attached to a door of the hollow core type, with the fasteners projecting through the C-shaped brackets directly into the frame members of the door or permits the rack to be secured to a wall with the C-shaped brackets adjusted appropriately to allow the fasteners passing through the brackets to engage the studding within the wall.

By forming the brackets of C-shaped construction, the front face of the brackets is left open to prevent interference with the tie supporting members projecting from the front face of the base plate, yet the base plate is slidably received in the brackets. As a result the base plate can be formed inexpensively from a single piece of wood, plastic or the like, and the brackets can be formed inexpensively of sheet metal or of molded plastic construction.

From the above and the following detailed description it will be seen that the present invention provides a combination tie rack having adjustable attaching brackets and adapted to support both untied, four-in-hand ties and pretied neckties, but which, through the unique cooperation of the components of the tie rack, may nonetheless be produced by relatively simple manufacturing processes and at relatively low cost.

DESCRIPTION OF THE PREFERRED EMBODIMENT

Figure 3:
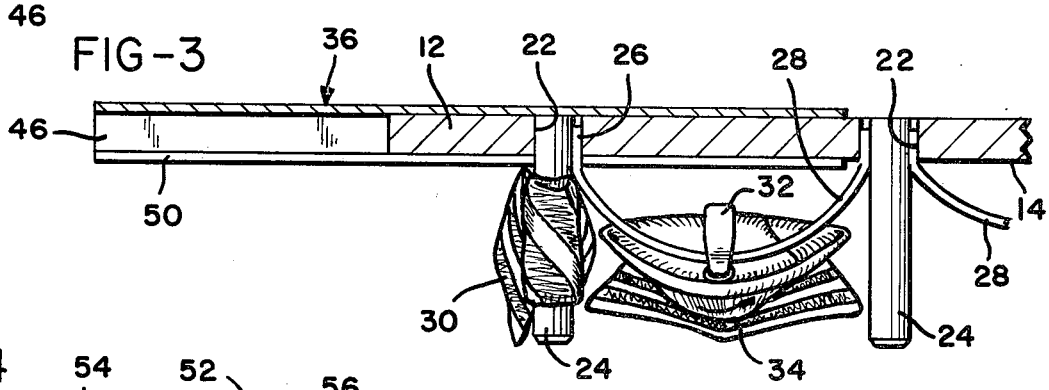
FIG. 3 is a cross-sectional view taken on line 3—3 of FIG. 2.

With reference to the drawings, it will be noted that a tie rack 10 in accordance with the present invention includes a base plate 12 having a front face 14, a rear face 16 and upper and lower edges 18 and 20, respectively. As best seen in FIG. 3 of the drawings, sockets 22 are formed in the base plate 12 at regularly spaced intervals and receive posts 24. Each of the sockets 22 also accommodates the end portions 26 of loops 28.

Figure 1:
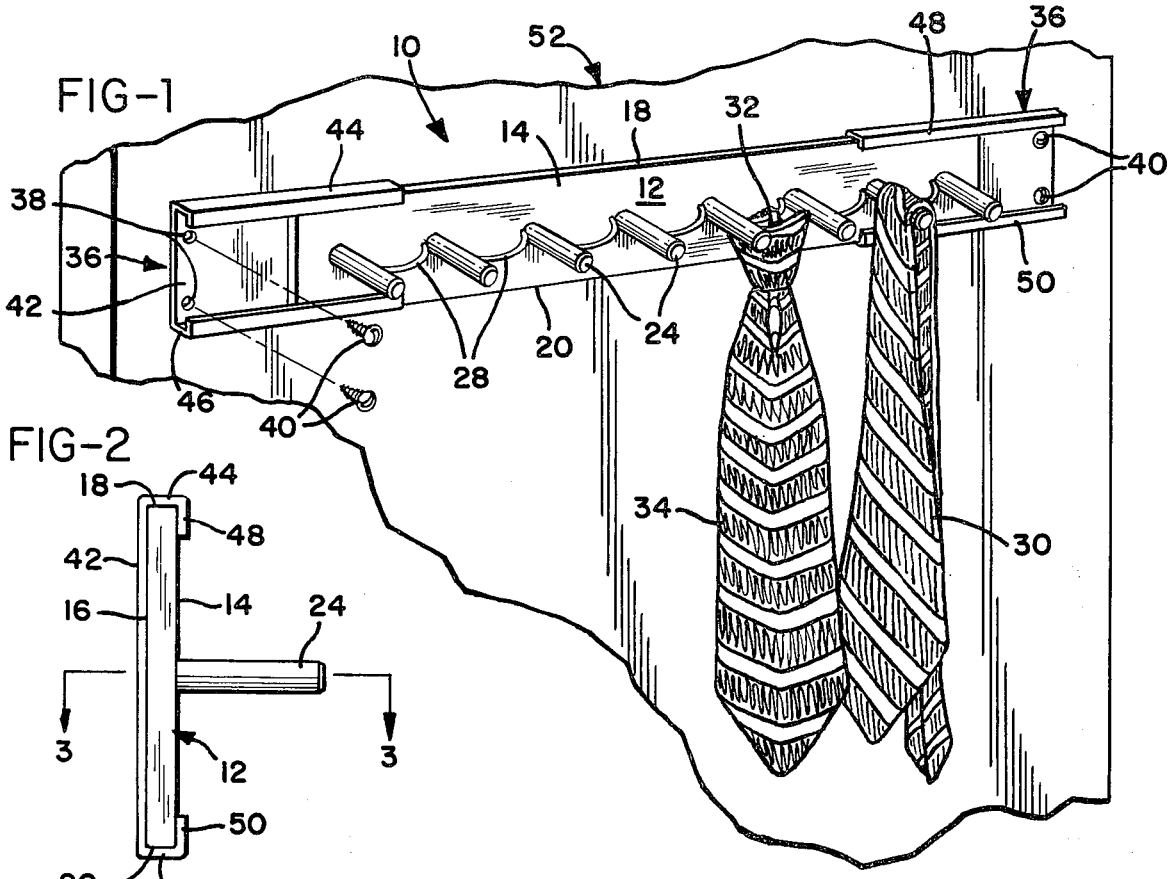
FIG. 1 is a perspective view of a tie rack in accordance with the present invention attached to a supporting member and showing for purposes of illustration two different types of ties supported thereby.
Figure 2:
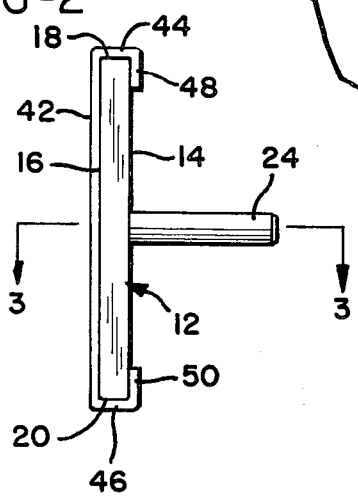
FIG. 2 is an end view of the tie rack of the present invention.

As is apparent from an inspection of FIGS. 1 and 3 of the drawings, the posts 24 accommodate untied ties 30 of the four-in-hand type, which are simply draped over the post 24 while the loops 28 are engaged by the clips 32 of pretied neckties 34. It will be noted that the sockets 22 accommodate both the ends 26 of the loops 28 and the posts 24, resulting in simplified manufacturing operations, and that the spacing between adjacent posts and loops is such that all of the posts and loops can be occupied simultaneously by, respectively, untied and pretied neckties.

It will often be desirable to attach the tie rack 10 to a supporting surface, such as a hollow core door or a conventional wall containing internal studding. In either case, it is desirable that the tie rack be attached directly to structural members rather than to merely the sheathing. This is accomplished in accordance with the present invention by providing opposite ends of the base plate 12 with substantially C-shaped brackets 36 having openings 38 therethrough to accommodate screws or other fasteners 40.

The brackets 36 are slidably and telescopically received on opposite ends of the base plate 12, each bracket including a rear portion 42, upper and lower edges 44 and 46, and upper and lower front portions 48 and 50. As a result, the rear face 42 of the bracket overlies the rear face 16 of the base plate, the upper and lower edges 44 and 46 overlie the upper and lower edges 18 and 20 of the base plate and the upper and lower front portions 48 and 50 of the bracket overlie portions of the front face 14 of the base plate adjacent the upper and lower edges thereof.

This provides a strong yet adjustable connection between the brackets and the base plate, while at the same time obviating any interference between the brackets and the tie supporting posts and loops 24 and 28, regardless of the extent to which the base plate is telescoped within the brackets 36.

Figure 4:
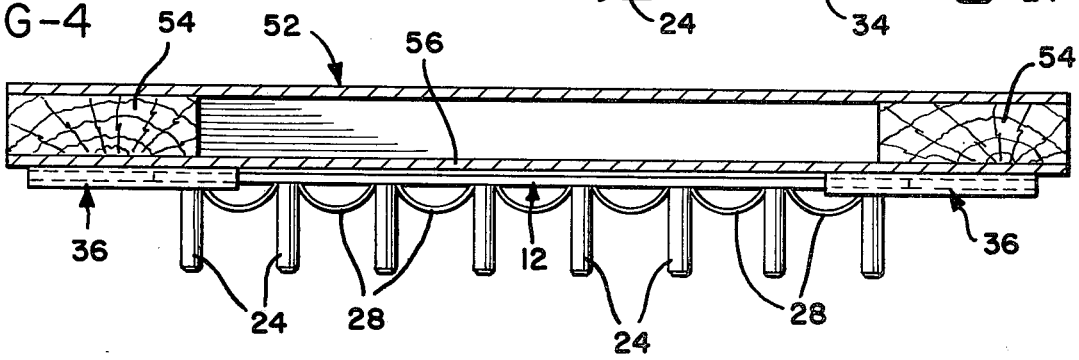
FIG. 4 is a top plan view of the tie rack of the present invention showing it attached directly to the structural members of a supporting member.

As will be apparent from FIG. 4 of the drawings, where a door 52 is shown for purposes of illustration as a supporting member, the brackets 36 are adjusted so that they overlie the frame members 54, so that the rack 10 can be attached directly to the frame members 54 of the door rather than to the sheathing 56 thereof.

From the above it will be seen that the present invention provides an adjustable, combination tie rack adapted to support simultaneously both pretied and untied neckties, but in which the components of the tie rack cooperate to provide simplicity of construction and relatively low manufacturing costs.

While the article herein described constitutes a preferred embodiment of the invention, it is to be understood that the invention is not limited to this precise article and that changes may be made therein without departing from the scope of the invention.

What is claimed is:

1. A combination tie rack comprising:

a. an elongated, substantially rectangularly shaped base plate having front and rear faces thereon, b. a plurality of sockets formed in said base plate at said front face thereof at uniformly spaced intervals along said front face, c. a plurality of posts having the bases thereof received in said sockets, d. said posts projecting from said front face of said base plate substantially perpendicularly with respect thereto and thereby being shaped to support untied neckties thereon, e. a plurality of discrete, semi-circular wire loops projecting outwardly perpendicularly from said front face of said base plate, f. ends of each of said wire loops being received in adjacent sockets with said posts, thereby disposing said loops intermediate said posts, g. said wire loops being adapted to be engaged by the hooks of pretied neckties to suspend pretied neckties therefrom and the spacing between said posts and said loops being such that all of said posts and said loops can be occupied simultaneously by untied and pretied neckties, respectively, h. a pair of substantially C-shaped attaching brackets telescopically receiving opposite ends of said base plate, i. said attaching brackets, at each end of said base plate, overlying said rear face and upper and lower edges of said base plate and portions of said front face adjacent said upper and lower edges, and j. openings formed through said base plate to receive fasteners therethrough, thereby adapting said base plate for direct attachment to internal structural members of a vertical supporting surface.

2. A combination tie rack comprising:

a. an elongated base plate having front and rear faces, b. a plurality of discrete posts received in sockets formed in said base plate at regularly spaced intervals, c. said posts projecting outwardly from said front face of said base plate at an angle thereto such that said posts are adapted to support untied neckties draped thereover, d. a plurality of wire loops mounted on said front face of said base plate at points thereon adjacent bases of said posts and projecting ouwardly from said base plate in the same direction as said posts, e. said loops being adapted to be engaged by the hooks of pretied neckties to thereby suspend pretied neckties therefrom, f. said loops being disposed intermediate said posts, g. said loops having opposite ends received in said sockets, and h. the spacing between adjacent posts and loops being such that untied neckties can be suspended from all of said posts while pretied neckties are suspended simultaneously from all of said loops.

* * * * *